US006203189B1

(12) United States Patent
Schäfer

(10) Patent No.: US 6,203,189 B1
(45) Date of Patent: Mar. 20, 2001

(54) MANUAL CONTROL DEVICE FOR A WATCH

(75) Inventor: Georges Schäfer, Le Brassus (CH)

(73) Assignee: Blancpain S.A., Le Brassus (CH)

( * ) Notice: Subject to any disclaimer, the term of this patent is extended or adjusted under 35 U.S.C. 154(b) by 0 days.

(21) Appl. No.: 09/290,225

(22) Filed: Apr. 13, 1999

(30) Foreign Application Priority Data

Apr. 22, 1998 (EP) ..... 98201292

(51) Int. Cl.[7] ..... G04B 29/00
(52) U.S. Cl. ..... 368/320; 368/321
(58) Field of Search ..... 368/319–321, 368/263, 64

(56) References Cited

U.S. PATENT DOCUMENTS 4,364,674 * 12/1982 Tesch ..... 368/319
4,423,966 * 1/1984 Ogihara et al. ..... 368/263
4,477,194 * 10/1984 Michel et al. ..... 368/69
4,740,936 * 4/1988 Tanaka ..... 368/319

FOREIGN PATENT DOCUMENTS 672 868 1/1990 (CH) .
1166504 11/1958 (FR) .
364878 1/1932 (GB) .
WO 97/46921 12/1977 (WO) .

* cited by examiner

*Primary Examiner*—Bernard Roskoski
(74) *Attorney, Agent, or Firm*—Griffin & Szipl, P.C.

(57) ABSTRACT

The invention concerns a manual control device for a watch including a bolt sliding on the external surface of a watch case, in particular to set a repeater mechanism, said bolt being connected through an opening arranged in said watch case to a sliding block controlling the desired function, said device further including a sealing gasket arranged around said opening and control means associated with said bolt, said control means allowing said device to pass from a first state, called the rest state, in which the bolt is locked with respect to the case and said gasket is compressed, to a second state, called the setting state, in which the bolt is unlocked and said gasket is not compressed, characterised in that said sealing gasket is arranged to be applied around said opening between said bolt and the external surface of the case and in that the control means include an articulated lever provided with an eccentric portion, said lever allowing said device to pass from the setting state to the rest state and vice versa.

9 Claims, 3 Drawing Sheets

MANUAL CONTROL DEVICE FOR A WATCH

BACKGROUND OF THE INVENTION

The present invention concerns a manual control device for a watch and more particularly a device of this type including a bolt sliding on the external surface of a watch case, in particular for controlling or setting a repeater mechanism.

FIG. 1 shows a control device for a watch of the aforementioned type belonging to the prior art and corresponding to Swiss Patent No. 672 868. This control device includes a bolt 2 sliding on the external surface 4 of a watch case 6 and mechanically connected through an oblong opening 8, made in case 6, to a sliding block 10 which co-operates with the arm of a rack (not shown) for controlling the striking work of a repeater mechanism. A sealing gasket 12 is arranged between the sliding block 10 and the inner wall 14 of case 6. This control device further includes means 16 for locking bolt 2 which can be moved in relation to the latter, between a first position in which gasket 12 is compressed between sliding block 10 and wall 14 to assure sealing of the control device, and a second position in which gasket 12 is not compressed and allows the movement of bolt 2 with respect to case 6 to cause the repeater mechanism to strike. Bolt 2 includes a groove 18 in which slides a locking member 20. This member 20 includes a stop 22, an oblong hole 24, a portion of small thickness 26 extending into bolt 2, connected via a ramp 28 to a thicker portion 30 which emerges from bolt 2. A screw 32 connects, through wall 14 and hole 24, bolt 2 to sliding block 10, a self-lubricating pad 34 being inserted between member 20 and bolt 2. A gasket 36 is also provided between the head of screw 32 and sliding block 10. In FIG. 1, bolt 2 is in the rest position, gasket 12 is compressed and bolt 2 cannot be moved. In order to cause the repeater mechanism to be set, the user moves member 20 with his nail in the direction of arrow F with respect to case 6 and bolt 2 until stop 22 comes into contact with pad 34. Portion 26 of member 20 is then at right angles to pad 34, gasket 12 is decompressed and bolt 2 can be moved in the opposite direction to arrow F, driving with it sliding block 10, which sets the repeater mechanism. When bolt 2 is released, it is brought into the rest position by return means, causing during the movement thereof actuation of the repeater mechanism and, thereby, the successive striking of the hours, quarters and minutes in the case of a minute-repeater.

This device however poses the significant risk of bolt 2 becoming locked before having reached its rest position during its return to such position, thus leading to incomplete striking of the minutes, the quarters and even the hours. The significant surface area of gasket 12 as well as the nature of the material of which it is made, in this case neoprene, has a significant friction coefficient with respect to wall 14, which is liable to block bolt 2 in an intermediate position if the latter is not accompanied manually. This risk is further increased by the presence of ramp 28 which pad 34 has to raise again for bolt 2 to return to its rest position.

Moreover, the control device compels the user to exert a relatively large force on the locking member in order to release bolt 2, at the risk of hurting himself, or breaking his nail.

SUMMARY OF THE INVENTION

The main object of the present invention is thus to overcome the drawbacks of the aforementioned prior art, by providing a manual control device for a watch, in particular for setting a repeater mechanism, which operates reliably.

Another object of the invention is to provide a manual control device for a watch which allows sealing of the interior of the case as regards the exterior thereof to be assured simply and economically.

Another object of the invention is to provide a manual control device for a watch which is easy for the user to manipulate, without detracting from the aesthetic appearance of the watch.

The invention therefore concerns a manual control device for a watch including a bolt sliding on the external surface of a watch case, in particular to set a repeater mechanism, said bolt being connected through an opening arranged in said watch case to a sliding block controlling the desired function, said device further including a sealing gasket arranged around said opening and control means associated with said bolt, said control means allowing said device to pass from a first state, called the rest state, in which the bolt is locked with respect to the case and said gasket is compressed, to a second state, called the setting state, in which the bolt is unlocked and said gasket is not compressed, characterised in that said sealing gasket is arranged to be applied around said opening between said bolt and the external surface of the case and in that the control means include an articulated lever provided with an eccentric portion, said lever allowing said device to pass from the setting state to the rest state and vice versa.

Thus, manipulation of the bolt by the lever is facilitated for the user.

According to an advantageous feature of the invention, said device further includes an elastic strip attached to said sealing gasket and fixed at one place on the bolt, and said control means act on said strip by the eccentric portion, at a distance from its point of fixation onto the bolt.

As a result of this feature, the lever can assure simply and efficiently, not only the compression of the sealing gasket against the external surface of the case via the strip, but also the locking of such lever in the rest state thereof. Moreover, in the setting state, the connection of the sealing gasket to the elastic strip allows the gasket to be kept at a distance from the external surface of the case, thus removing any problem of friction of the gasket on said surface. Consequently the return movement of the bolt after setting is not hindered in any way.

BRIEF DESCRIPTION OF THE DRAWINGS

Other features and advantages of the present invention will appear in the following description of a preferred embodiment, given by way of non limiting example with reference to the annexed drawings, in which.

DETAILED DESCRIPTION OF THE PREFERRED EMBODIMENTS

The description of the manual control device according to the invention which follows will be made within the scope of an advantageous application to the setting of a repeater mechanism which strikes the hours, the quarters and the minutes in a wristwatch. However, it goes without saying that the invention is in no way limited to this application and that it could advantageously be used in the control of any other function.

Figure 1:
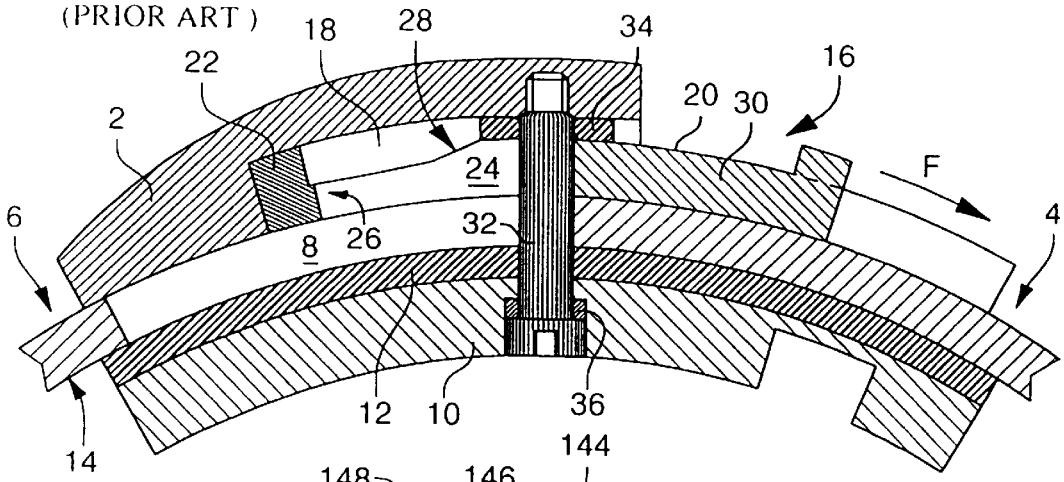
Fig. 1 (PRIOR ART)
FIG. 1 is a cross-section of the manual control device of the previously described prior art.
Figure 2:
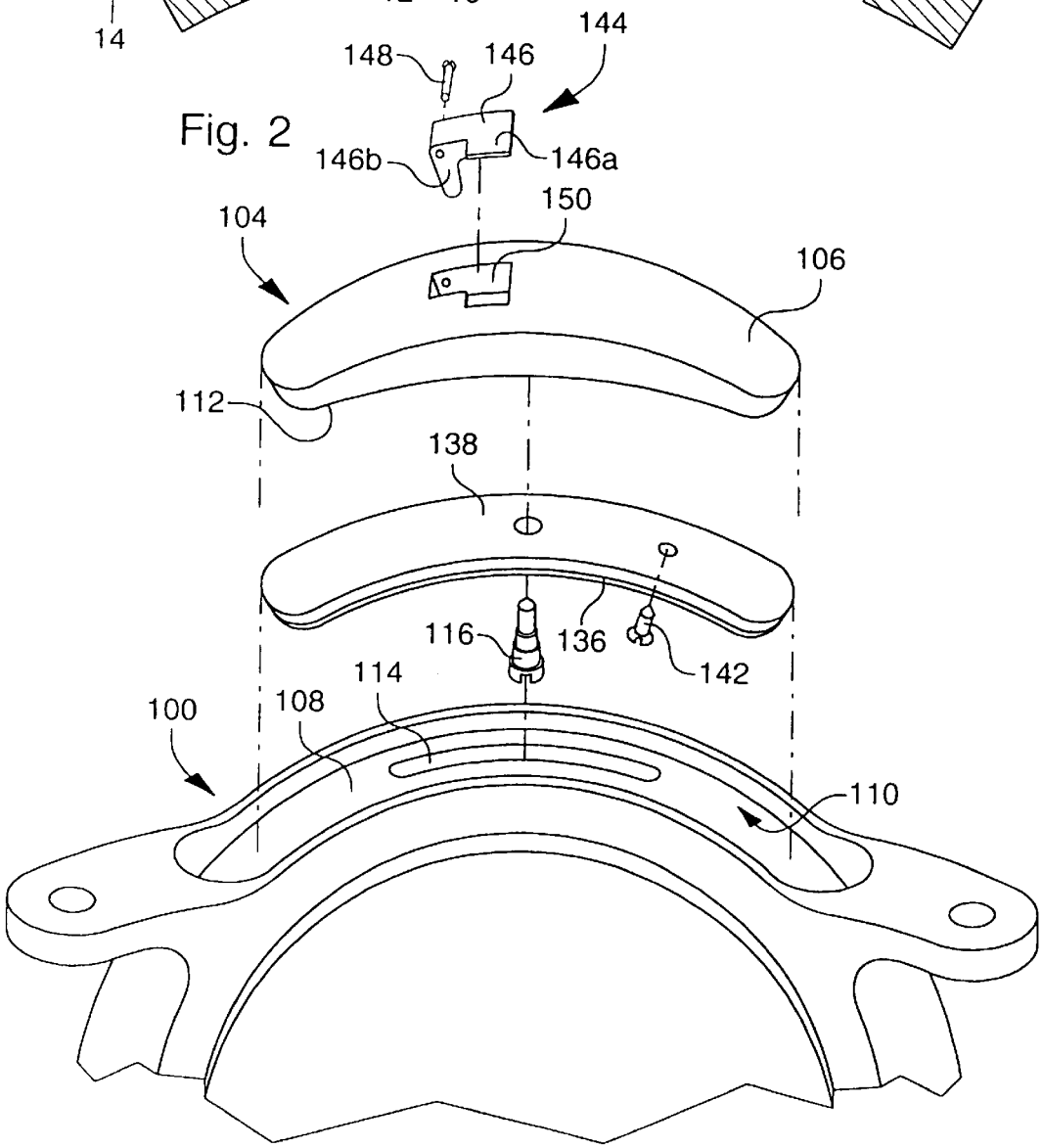
FIG. 2 is a blown up perspective view illustrating the control device according to the invention.
Figure 3:
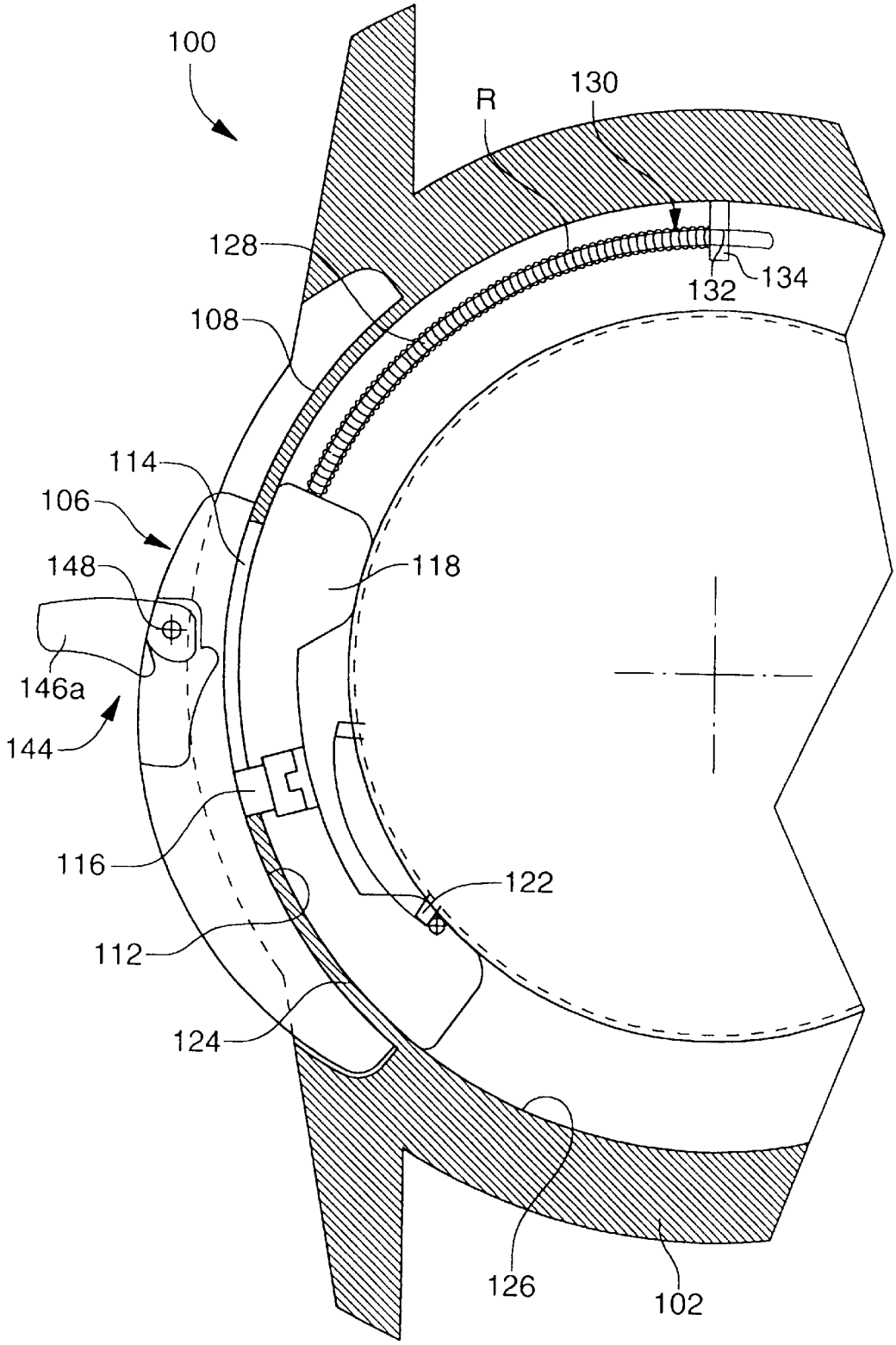
FIG. 3 is a half top view in partial cross-section of a watch case fitted with a control device according to the invention.

The wristwatch shown schematically in FIGS. 2 and 3 includes in a conventional manner a case 100 formed of a middle part 102 of generally circular shape on which a manual control device according to the invention, designated by the general reference 104, is mounted.

Control device 104 includes a bolt 106 sliding on the external surface 108 of middle part 102 of case 100. In the example shown, surface 108 forms the bottom of an oblong recess 110 provided in middle part 102. The lower surface 112 of bolt 106 matches the shape of bottom 108, the shapes of this lower surface 112 and those of bottom 108 being such that bolt 106 can slide with respect to bottom 108. Bottom 108 includes an oblong opening 114 through which a screw 116 passes, said screw mechanically connecting bolt 106 to a sliding block 118 controlling, via a pin 120 an arm 122 which allows setting of a repeater mechanism which is not shown.

It will be noted in this regard that the length of opening 114 defines the useful travel of bolt 106 to achieve setting of the desired function. In the case of setting of a repeater mechanism, the length of this opening 114 is typically equal to approximately half the length of bolt 106.

Sliding block 118 has an upper surface 124 which matches the shape of inner surface 126 of middle part 102, the shapes of these surfaces 124, 126 being such that sliding block 118 can slide along inner surface 126. A stem 128 extends along an arc of a circle in the longitudinal extension of sliding block 118, the free end 130 of this stem 128 sliding into an orifice 132 of a tongue 134 extending perpendicular to inner surface 126 of middle part 102. A helical spring R is wound around stem 128 and extends between tongue 134 and sliding block 118, to return the latter to a determined position shown in FIG. 3.

According to a feature of the invention, control device 104 further includes a sealing gasket 136 arranged between external surface 108 of middle part 102 and lower surface 112 of bolt 106, and extending at least around opening 114. In the example illustrated, gasket 136 has substantially the shape of a strip which completely covers the surface of opening 114, the width of this strip being larger than the width of opening 114, and its length being substantially equal to that of bolt 106. Screw 116 thus passes through gasket 136 in a sealed manner. Gasket 136 is preferably made of elastomer or rubber, but any other synthetic or natural material generally used for making gaskets within the horological field can be envisaged.

According to another feature of the invention, gasket 136 is associated with a strip 138 which can move with respect to bolt 106 while being fixed thereto at one place, screw 116 of course also passing through strip 138. According to the embodiment described, strip 138 is an elastic strip and gasket 136 is fixed thereto, for example by bonding. More precisely, gasket 136 and strip 138 extend into an oblong recess 140 made in lower surface 112 of bolt 106 situated facing middle part 102. Strip 138 is fixed in the bottom of recess 140 by one its ends, for example using a screw 142, and its free end is returned by elasticity to the bottom. It will be noted in this regard that, preferably, the head of screw 142 is embedded in strip 138 and gasket 136 covers the head of screw 142.

Figure 4:
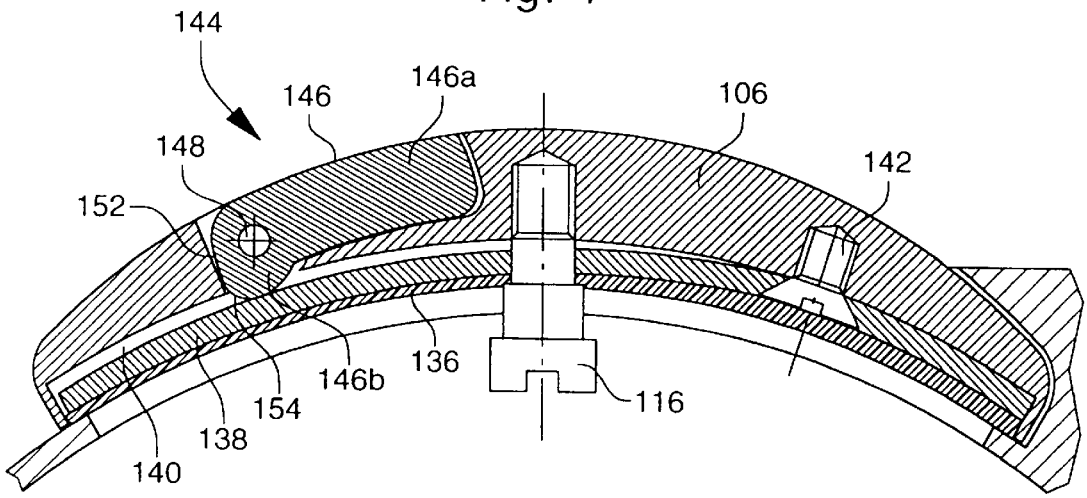
FIG. 4 is a cross-section perpendicular to the wall of the watch case of the control device according to the invention, the control means being in the rest position for the bolt.
Figure 5:
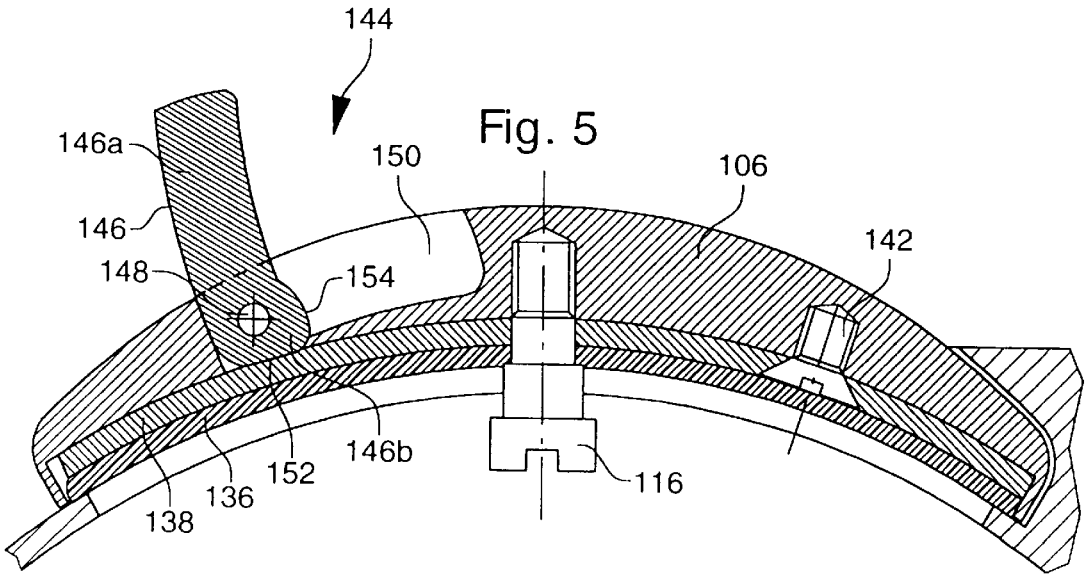
FIG. 5 is a similar cross-section to that shown in FIG. 4, the control means being in the setting position of the bolt.

Control device 104 also includes control means 144 associated with bolt 106 to cause device 114 from a first state called the rest state in which bolt 106 is locked, to a second state called the setting state in which bolt 106 is unlocked. In the rest state, bolt 106 cannot slide freely with respect to case 100 and gasket 136 is compressed against external surface 108 of middle part 102 (FIG. 4) so that the sealing of case 100 as regards the exterior is assured. In the setting state, bolt 106 can slide freely with respect to case 100 and gasket 136 is not compressed (FIG. 5), so that sealing is no longer guaranteed as regards device 104. In the example shown, control means 144 include a lever 146 articulated about an axis 148 attached to bolt 106, this lever 146 allowing control device 104 to pass from the setting state to the rest state and vice versa. Lever 146 includes a manipulation portion **146*a* and a control portion 146*b* which acts on strip 138 and which is formed of an eccentric. The Figures also show that lever 146 extends into a recess 150 made in external surface 108 of bolt 106 directed outwards with respect to middle part 102. This recess 150 opens out into oblong recess 140, eccentric portion 146*b* of lever 146 extending partially into recess 140 to come into contact with strip 138. The point of contact of eccentric portion 146*b* with strip 138 is at a distance from the point of fixation of strip 138 onto bolt 106 and is preferably close to the free end of strip 138. The shape of the profile of eccentric portion 146*b* is arranged so that, in the rest position portion 146*b* acts on strip 138 and gasket 136 and applies them firmly against external surface 108 of middle part 102 to block the sliding of bolt 106 and so that, in the setting position, portion 146*b* is drawn back sufficiently for strip 138 and gasket 136 to be released from external surface 112 and accommodated in recess 140, which then allows bolt 106 to slide with respect to middle part 102. For practical and aesthetic reasons it will be noted that, in the rest position, lever 146 is preferably embedded in recess 150 so as to be flush with the external surface of bolt 106 and, in the setting position, lever 146 projects with respect to bolt 106, thus facilitating manipulation of control device 104** for the user.

It will also be noted that, in the rest state of control device 104, the point of contact C of profile **146*b* with strip 138 is substantially offset with respect to the vertical V of the axis of articulation with respect to strip 138, which allows lever 146 to be maintained in a stable position in recess 150** without any other additional means.

In a similar manner when the device is in the setting state, profile **146*b*** is arranged so that the lever is maintained in a stable manner in the position described hereinbefore.

For this purpose, profile **146*b* includes a first convex portion 152 whose highest point is offset as regards the vertical of axis 148 with respect to strip 138 so that during the passage of lever 146 from its position corresponding to the setting state of device 104 to its position corresponding to the rest state of device 104, the highest point of portion 152 passes at right angles to axis 148 with respect to strip 138 and continues beyond to reach a position of stable equilibrium in which strip 138 is applied against middle part 102**.

First portion 152 is followed by a second substantially plane portion 154 against which elastic strip 138 is applied in the setting position. Lever 146 thus has two stable positions according to whether control device 104 is in the rest state or the setting state.

Certain modifications may be made to the control device according to the invention without thereby departing from the scope of this invention. Thus, for example, one could envisage omitting strip 138 and articulating lever 146 on screw 116, lever 146 then acting directly on bolt 102 which is applied onto external surface 112 of middle part 102 via gasket 136. Of course, bolt 106 is not attached to screw 116.

What is claimed is:

1. A manual control device for a watch, including:

a watch case having an external surface and an opening;

a sliding block arranged inside the watch case;

a bolt slidable on the external surface of the watch case, said bolt being connected through the opening arranged in said watch case to the sliding block;

a sealing gasket arranged around said opening between the bolt and the external surface of the watch case; and an articulated lever provided with an eccentric portion the articulated lever being disposed on the bolt and movable from a first state, called a rest state, in which the bolt is locked with respect to the case and the gasket is compressed, to a second state, called the setting state, in which the bolt is unlocked and the gasket is not compressed.

2. A control device according to claim 1, further comprising a strip attached to said sealing gasket and wherein said articulated lever acts on said strip.

3. A control device according to claim 2, wherein the strip is elastic and is fixed at a place onto the bolt and wherein the articulated lever acts via its eccentric portion on said strip at a distance from the place at which the strip is fixed onto the bolt.

4. A control device according to claim 3, wherein in the rest state, the eccentric portion of the articulated lever has a point of contact with the strip that is substantially offset with respect to a vertical of an axis of articulation of the lever with respect to the strip.

5. A control device according to claim 2, wherein in the setting state, a profile of the eccentric portion is arranged so that the articulated lever is held in a stable position.

6. A control device according to claim 2, further comprising an oblong recess made in a surface of the bolt facing the case, wherein the strip and the sealing gasket extend in the oblong recess.

7. A control device according to claim 2, wherein the articulated lever extends into a recess made in a face of the bolt extending outwards with respect to the case.

8. A control device according to claim 7, wherein in the rest state, the articulated lever is embedded in said recess so that it is flush with an external surface of the bolt.

9. A control device according to claim 1, wherein said sealing gasket is bonded to said strip.

* * * * *